United States Patent [19]

Welch

[11] 4,193,149

[45] Mar. 18, 1980

[54] BEDS AND MATTRESSES

[76] Inventor: Robert J. D. Welch, 20 Abercorn Pl., St. John's Wood, London NW. 8, England

[21] Appl. No.: 890,459

[22] Filed: Mar. 27, 1978

[30] Foreign Application Priority Data

Mar. 29, 1977 [GB] United Kingdom ..... 13223/77

[51] Int. Cl.[2] ..... A61H 1/00; A61G 7/10

[52] U.S. Cl. ..... 5/447; 5/450; 5/453; 5/456; 128/38

[58] Field of Search ..... 5/60, 349–350, 5/365, 368; 128/33, 38, 50, 24 R; 297/284

[56] References Cited

U.S. PATENT DOCUMENTS

| | | | |
|---|---|---|---|
| 2,998,817 | 9/1961 | Armstrong | 5/368 |
| 3,492,988 | 2/1970 | De Mare | 128/33 |
| 3,631,438 | 12/1971 | Lewin | 5/368 |
| 3,674,019 | 7/1972 | Grant | 128/3 |
| 3,678,520 | 7/1972 | Evans | 5/91 |

*Primary Examiner*—Casmir A. Nunberg

*Attorney, Agent, or Firm*—Lockwood, Dewey, Alex & Cummings

[57] ABSTRACT

A multi-layer mattress comprises inflatable tubes each of which extends across a dimension of the mattress and form part of one of a number of arrays extending through each layer. All the tubes of any one array of which there are optimally three, are inflatable in common and are arranged in substantial vertical alignment with a corresponding array in another layer. Sequential inflation and deflation of each array causes ripples to travel along the mattress so that a patient lying on it has his weight-supporting areas continually changed. A preferred embodiment has two layers of tubes, each tube of which extends across a width of the mattress.

14 Claims, 11 Drawing Figures

BEDS AND MATTRESSES

FIELD OF THE INVENTION

The present invention relates to beds and mattresses.

BACKGROUND TO THE INVENTION

It is well known that when a patient is confined to bed for a prolonged period, he may develop such distressing symptoms as bedsores or rashes on the parts of his body that press on the bed to support his weight. A major cause of the ill effects is the occlusion of the blood capillaries near the surface of the skin caused by the pressure. If a region of flesh is deprived of blood for long, then sores may result.

It is known to provide an inflatable mattress or pad comprising inflatable and deflatable flexible tubes laid side by side across the bed, alternate tubes being joined by conduits, so that the tubes form two interdigitated arrays which are connected to a pump assembly which inflates one array while deflating the other, and which alternates so that each array is periodically inflated and deflated. At any given moment the patient is supported by the tubes of the array which is inflated, whereas the parts of his body which are over the deflated (and therefore collapsed) tubes are subject to substantially no pressure from the mattress, and therefore enjoy a free circulation of blood. Before the constriction of capillaries or other consequence of the pressure on the load-bearing parts of the body can cause harm, the pressure is removed from those parts and re-applied at the formerly pressure-free parts. Thus the mattress ripples, and the weight-supporting areas of the body of the patient are changed.

Plastics materials are generally unpleasant to lie on directly, tending to cause sweating. It is known to interpose between patient and mattress a layer of foam or woollen material, and to make the upper surface of the mattress porous so that air passes through the body support area and in order to dry perspiration.

For ease and cheapness of construction, it is convenient for the tubes to be of plastics material and of substantially circular or elliptical cross-section when inflated. With the prior devices, it is found that if the weight of the patient is very unevenly distributed, for example, when the patient sits up, the tubes bearing the bulk of the weight are insufficiently resilient: the air is forced from the parts of the tubes that are hardest pressed, the patient is effectively supported by whatever is beneath the inflatable mattress, and the benefits of the appliance are not obtained.

This problem might be obviated:

(i) by increasing the pressure of air in the inflated tubes. However, a very considerable increase would be needed to get the desired effect and this would present problems regarding the strength of the material and the pump, and might furthermore result in an unacceptably hard and uncomfortable mattress.

(ii) by increasing the vertical depth of the tubes. However, if tubes of substantially circular cross-section were used, a large diameter would be required, and therefore the patient would be supported in only a few widely-spaced regions, which would not be comfortable. If tubes of greater depth than width were used, the inflated load-bearing tubes would tend to deform and fill the voids left by the deflated tubes, thus removing the desired alternation, unless tubes having internal restraining structure were used. Such tubes are expensive to make.

SUMMARY OF THE INVENTION

It is an object of the present invention to provide a mattress which is both comfortable for the patient to lie on and continually changes the pressure points experienced by the patient.

According to the present invention there is provided a mattress comprising a plurality of inflatable tubes each of which extends across the mattress, said tubes being arranged in at least two layers wherein the tubes of each said layer are in side by side arrangement and are divided into a plurality of arrays so that all the tubes of each respective array are inflatable in common and, in use, are disposed in substantial vertical alignment with the tubes of a corresponding array in another layer. Merely piling one layer on top of another would not result in an arrangement in which the tubes of one layer are accurately registered with the tubes of another layer; the two layers will slip over each other and in effect revert to a single layer mattress. This disadvantage is particularly realised when the mattress comprises only two layers of tubes which is a preferred thickness for the mattress.

The tubes in each layer preferably extend across the width of the mattress, but they could be longitudinally disposed or even at an angle to the length and breadth of the mattress. To ensure that the tubes of each respective array are arranged substantially above or below the tubes of a corresponding array in another layer it is convenient to include one or more formers. In the case where the tubes of each layer extend across a width of the mattress a former is conveniently included at each lateral edge of the mattress so that it extends a length of the mattress in between adjacent layers of tubes. Preferably means are provided to secure each layer detachably to its respective formers. Each former is suitably made of a resilient material such as expanded polyethylene, for example "Ethafoam" of Dow Chemicals Inc.

The height of two layers of tubes when both tubes, one above the other, are inflated is quite considerable and when there are only two arrays the longitudinal gap between the inflated tubes (provided by uninflated tubes of the other array) can be insufficient at least when the most economic mode of construction of the tubes, as simple cylindrical tubes, is used to afford all the area of pressure relief for the patient that could be available for that height of mattress.

It is therefore particularly preferred that the tubes, which can however have a cross section other than cylindrical, of each said layer are divided into at least three said arrays, the members of each array being preferably joined by conduits. If there are n arrays, the sequence of tubes in each layer is "1,2,3...n, 1,2,3...n,1,2...". The said plurality of arrays is preferably adapted for connection to a pump assembly so that, in use, the said arrays are inflated and deflated sequentially to cause ripples to travel from the tubes of the first array to the tubes of the nth array. It is to be understood that the present invention also extends to a mattress in combination with a pump and distributing means whereby the said arrays are inflated and deflated sequentially.

Adjacent tubes in each said layer are conveniently mechanically joined along at least a part of their length.

An upper surface of tubes forming an upper layer may be perforated to allow limited passage of gas through it.

As will appear, the provision of three arrays can maximise the pressure relief available to the patient and can allow adoption of an inflation/deflation pattern which can be of special benefit to the patient.

In the event of the patient applying an increased amount of pressure to any one area of the mattress sensor means can be provided which are adapted, in use, to increase inflation pressure in the said tubes.

It is to be understood that the present invention extends a bed incorporating the said mattress.

DESCRIPTION OF THE PREFERRED EMBODIMENTS

Figure 1:
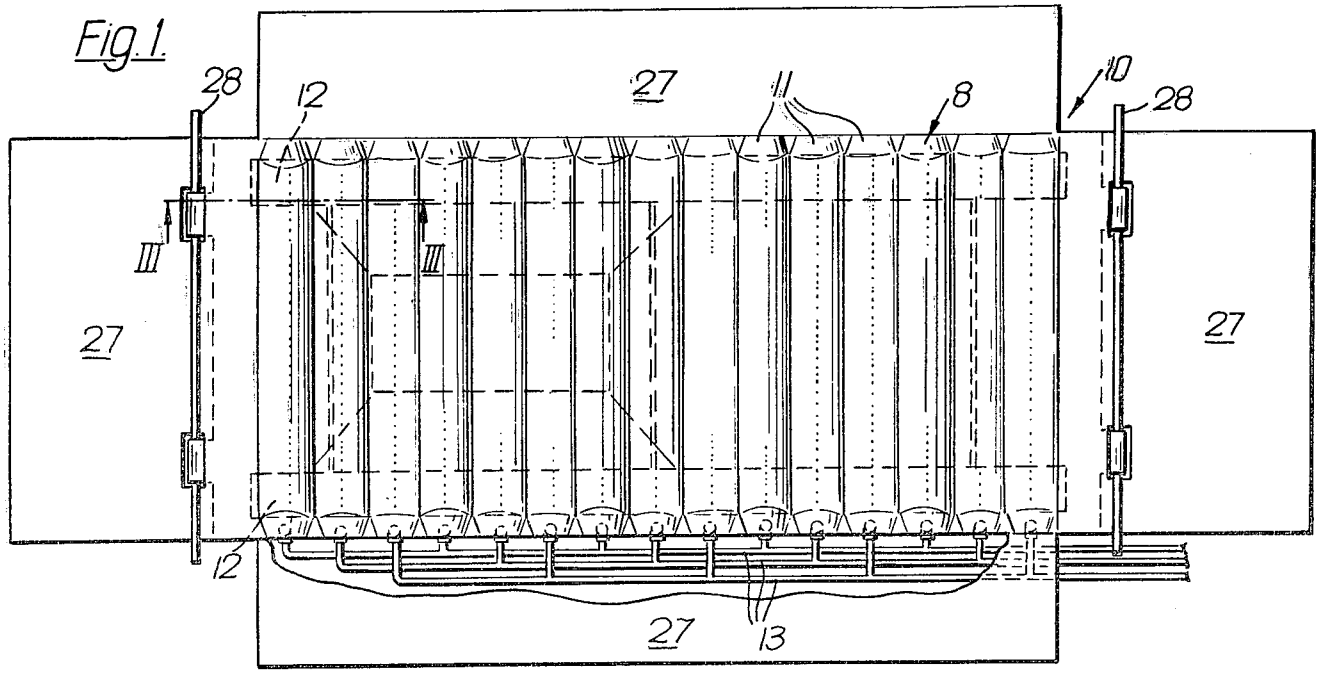
FIG. 1 is a plan view, partially cut away, of one embodiment of mattress.
Figures 2, 9:
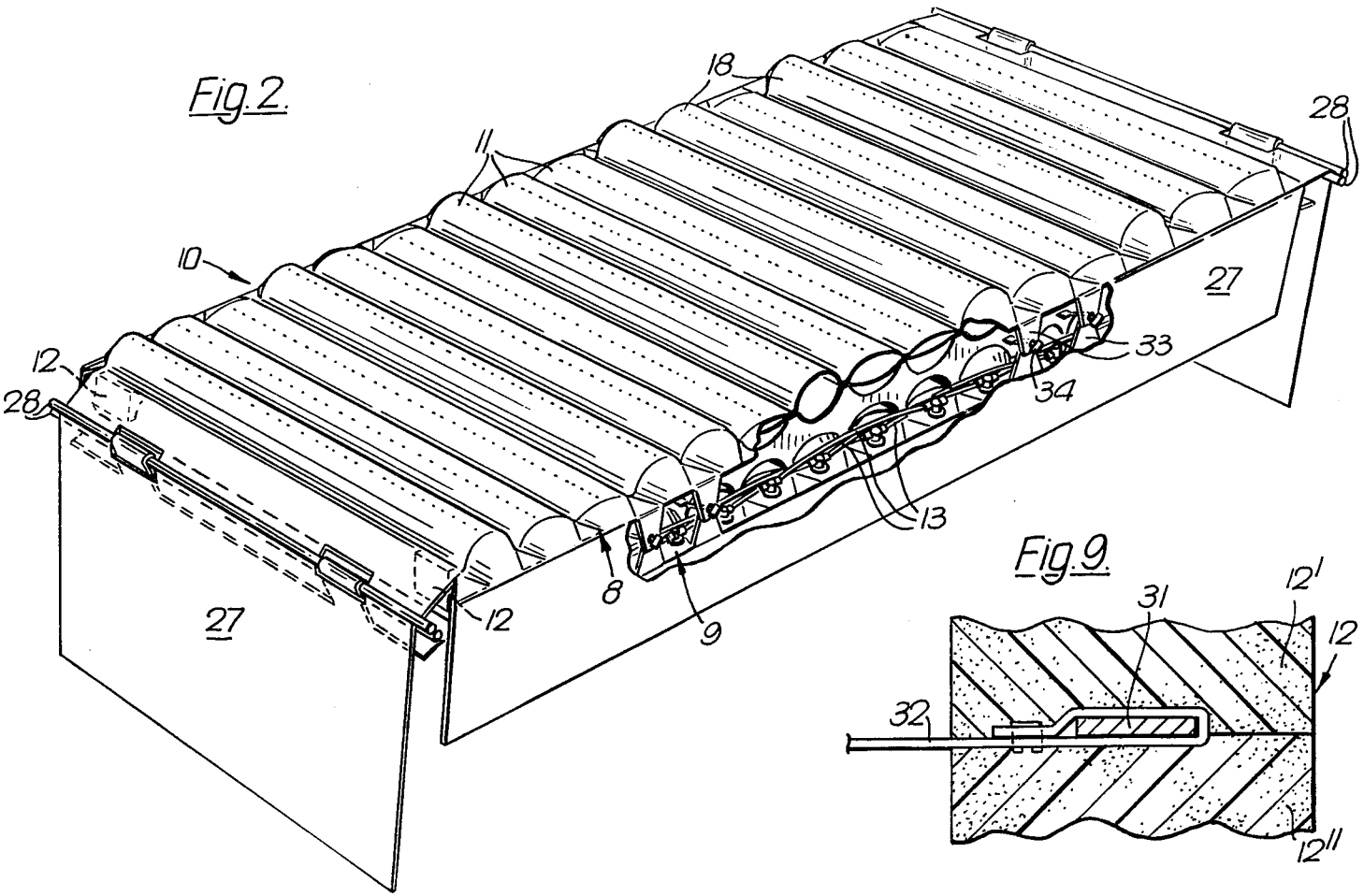
FIG. 2 is a perspective view, partially cut away, of the mattress of FIG. 1.
FIG. 9 is a section along line IX—IX of FIG. 8.
Figure 3:
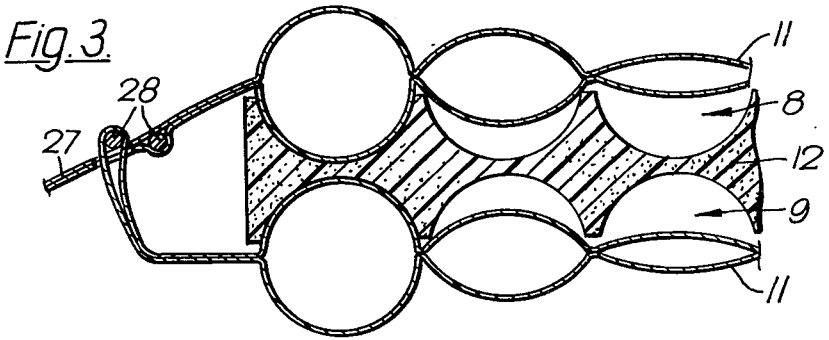
FIG. 3 is a section along line III—III of FIG. 1.
Figure 7:
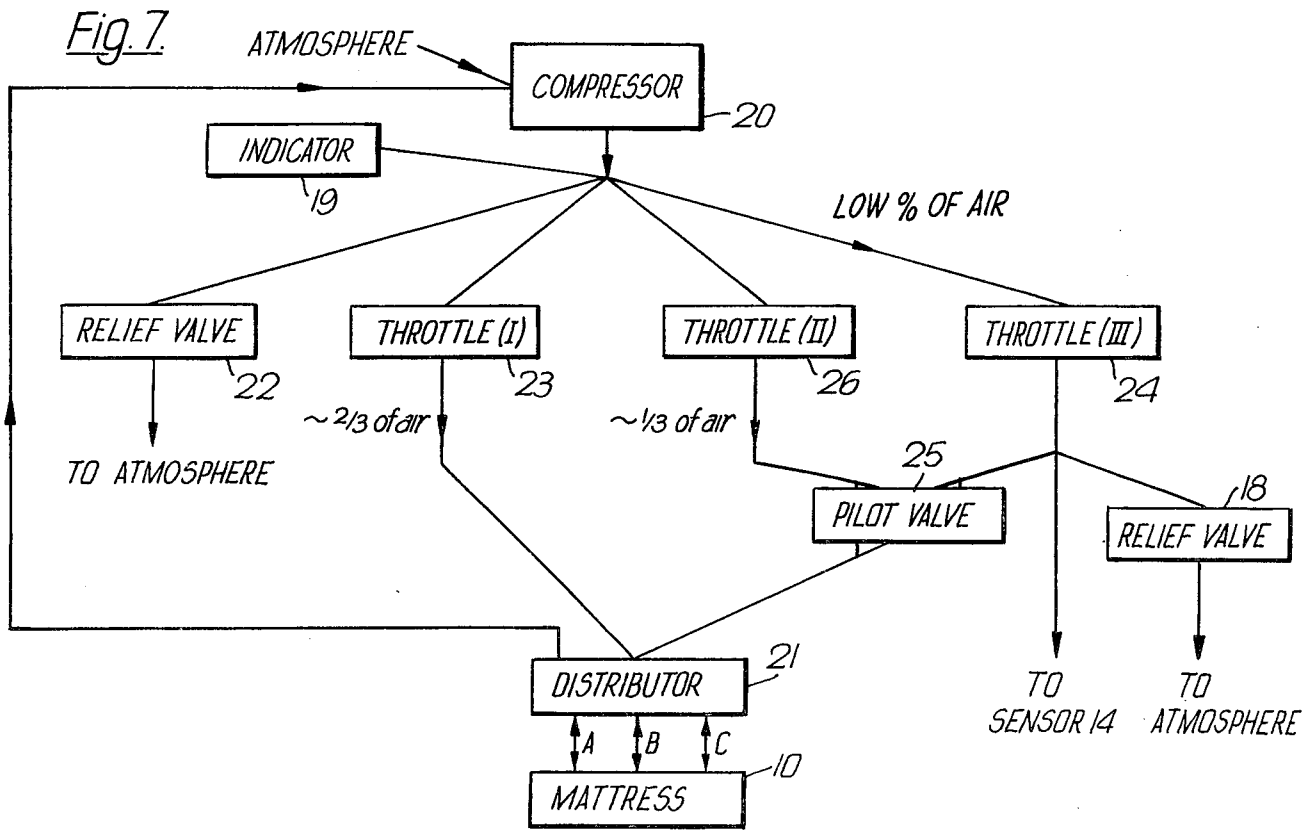
FIG. 7 is a block diagram of air supply and control apparatus.

Referring firstly to FIGS. 1 and 2 a mattress, shown generally at 10, comprises a plurality of substantially equal inflatable and deflatable flexible tubes 11 which form two substantially equal layers 8 and 9 each layer consisting of tubes 11 joined laterally, with layer 8 superposed over the layer 9. The tubes in the upper layer 8 are held substantially vertically above the tubes in the lower layer 9 by means of two formers 12 of resilient foam material adjacent the ends of the tubes. The upper surface of the upper tubes has a plurality of very small perforations 18. Each tube 11 is connected by a conduit 13 attached adjacent one end to the tube 11 directly above or beneath it and to every third tube in its layer. The conduits 13 are only shown for the tubes 11 of the lower layer 9 for the sake of simplicity in FIG. 2. An identical set of conduits is provided for the tubes of the upper layer 8. There are thus three arrays A, B and C of tubes 11, and each array is connected to a pumping and control system. The system is shown diagrammatically in FIG. 7. A compressor 20 provides pressure and vacuum for the arrays. Distributor 21 (e.g. motor driven distributor valves or solenoid valves switched from a camshaft) cyclically connects the arrays to sources of pressure and of vacuum so that each array is successively (i) inflated, (ii) allowed to deflate partially by seepage through the perforations, and (iii) actively deflated by connection to the vacuum source.

Figure 10:
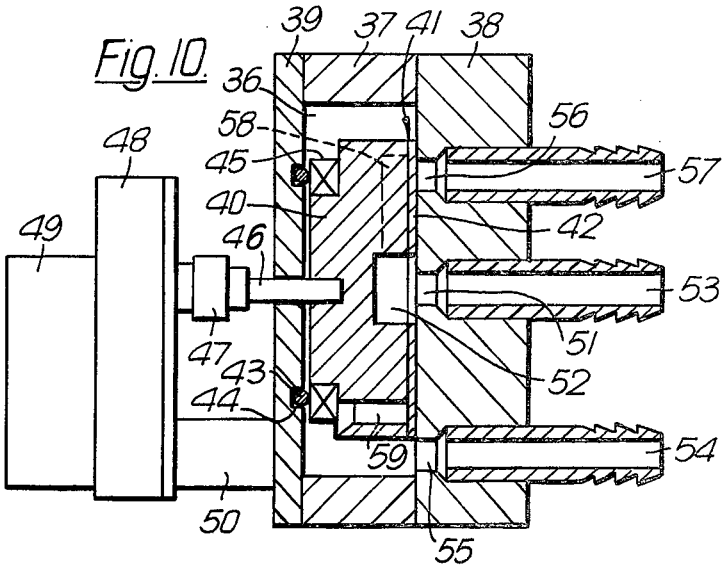
FIG. 10 shows, partly in section, a fluid distributing arrangement.
Figure 11:
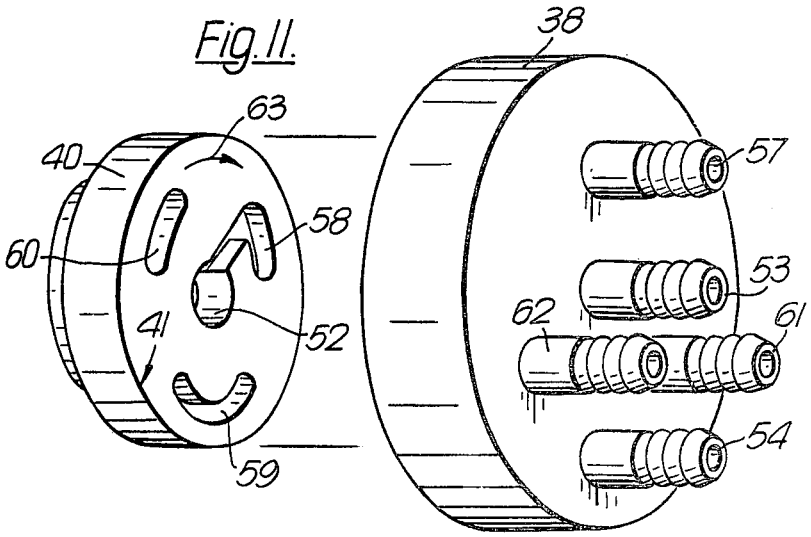
FIG. 11 is a simplified diagrammatic view showing the relationship of a rotor with a cover plate for the arrangement of FIG. 10.

The distributor 21 may be of any design which will function for the required purpose. A suitable form of distributor has been designed and forms the subject of United Kingdom patent application No. 5383/78 (Spenalex Engineering Co. Ltd.). Details of the design are shown in FIGS. 10 and 11, to which reference will now be made.

A chamber 36 formed by a hollow cylindrical body 37 has a cover plate 38 forming one end wall and a back plate 39 forming the other wall. The plates 38 and 39 are secured to the body 37 by conventional means, such as screws which are omitted for the sake of clarity from the drawing.

A rotor 40, formed from a circular plate, is contained within the chamber 36 and has a working face 41 abutting the end wall formed by the cover plate 38. The working face 41 is coated with a low friction sealing layer 42, such as PTFE, and the coated face 41 is maintained in contact with the plate 38 by a pressure "O" ring 43 housed in a circular recess 44 in the back plate 39 and in engagement with a thrust race 45 carried by the rotor 40.

The rotor 40 is rotated within the chamber 36 by a drive shaft 46 passing through the back plate 39, the axis of rotation coinciding with the axis of the body 37. The shaft 46 is coupled by means of a universal coupling 47 to a gearbox 48, whose input is driven by a drive motor 49, the gearbox 48 and motor 49 being supported on the back plate 39 of the distributor by a support member 50.

The cover plate 38 has a central aperture 51 and a central recess 52 is provided in the rotor 48. A tube 53 is provided in association with the aperture 51 for the attachment of a flexible tube (not shown) to connect the aperture 51 to a fluid supply. In the present case, the aperture 51 is connected to a vacuum pump (not shown) which forms a low pressure source. In a somewhat similar way a high pressure source (not shown) is connected to a connection tube 54 of an aperture 55 in the cover plate 38. The aperture 55 is so positioned in the cover plate 38 that it communicates with the interior of the chamber 36, being sealed from the working face 41 of the rotor 40.

An outlet aperture 56, provided with a connection tube 57, is provided in the cover plate 48 and is positioned radially a predetermined distance from the central axis, the distance being chosen to lie within the diameter of the working face 41 of the rotor 40. An extension 58, shown in FIG. 1 by a dashed outline, from the recess 52 of the working face 41, extends sufficiently far outwards from the recess 52 so that it will be brought into alignment with the outlet aperture 56 at some point during a cycle of rotation of the rotor 40.

An aperture 59 is provided in the rotor 40 extending through the rotor 40 to communicate with the interior of the chamber 36. The aperture 59 is radially spaced from the centre of the rotor 40 at a distance corresponding to the radial distance of the outlet aperture 56.

In operation, during each cycle of rotation of the rotor 40, the passage of the recess extension 58 in the rotor 40 permits the low pressure source connected to the connection tube 53 to be connected through the recess 52 and its extension 58 to the outlet tube 57 only when the rotor position is such that the extension 58 is aligned with the aperture 56; while at some other point in a single rotation cycle, the aperture 59 in the rotor 40 permits the high pressure fluid supply, provided in the chamber 36 by the connection 54 and aperture 55 in the cover plate 38, to be applied to the outlet connection tube 57.

The rotor 40 thus isolates the two fluid supplies and the sealing layer 42 of the rotor 40 provides a seal over the aperture 56 to prevent any movement of fluid through the connection tube 57.

The arrangement of the rotor 40 in association with the cover plate 38 is shown diagrammatically in greater detail in FIG. 11, the sealing layer being omitted for the sake of clarity. The rotor 40 has its aperture 59 arranged as an arcuate slot. A further aperture 60 passes right through the rotor 40 and is arranged as an arcuate slot of smaller angular extent than the aperture 59, from which it is angularly displaced. The extension 58 to the central recess 52 in the working face 41 of the rotor 40 also extends in an arc. With the fluid supply arrangement described above, consisting of a low pressure source connected to the tube 53 of the cover plate 38 and a high pressure source connected to the tube 54, it will be appreciated that if the rotor 40 is rotated in the direction indicated by arrow 63, then the outlet tube 57 is subjected to a repetitive cycle consisting of a low pressure suction stage from the aperture 58, followed by a sealed period until the recess 60 permits a period of high pressure fluid flow. This, in turn, is followed by a further sealed period which is succeeded by a further, but longer period of high pressure fluid flow caused by the passage of the aperture 59. Finally another sealed period follows until the entire cycle recommences with the passage of the aperture 58 once more.

If two further apertures, connected to tubes 61 and 62 as shown in the Figure are provided at the same radial displacement from the centre of the cover plate 38, it will be understood that these outlets too will be subject to the same fluid pressure cycle as is the outlet 57 and the timing of the cycle will depend on the relative angular dispositions of the respective outlets.

The high pressure connection tube 54 and its associated aperture could be provided directly to the body 37 of the distributor instead of to the plate 38, since its function is to connect a fluid pressure source to the interior of the chamber 36.

The duty cycle of any outlet, such as 57, from the distributor is controlled by the relative dispositions of apertures, such as 59, and/or recesses, such as 58, in the rotor 40. The relative timing cycles of a plurality of outlets is also seen to be controlled by the disposition of the outlets in the cover plate 38.

The timing of the duty cycle is accomplished by the suitable choice of motor and gearbox, which may, of course, be separately mounted. The distributor arrangement may be driven, for example, by a flexible drive. It will also be apparent that the distributor may be fitted with suitable brackets to permit it to be mounted on a suitable support.

Figure 4:
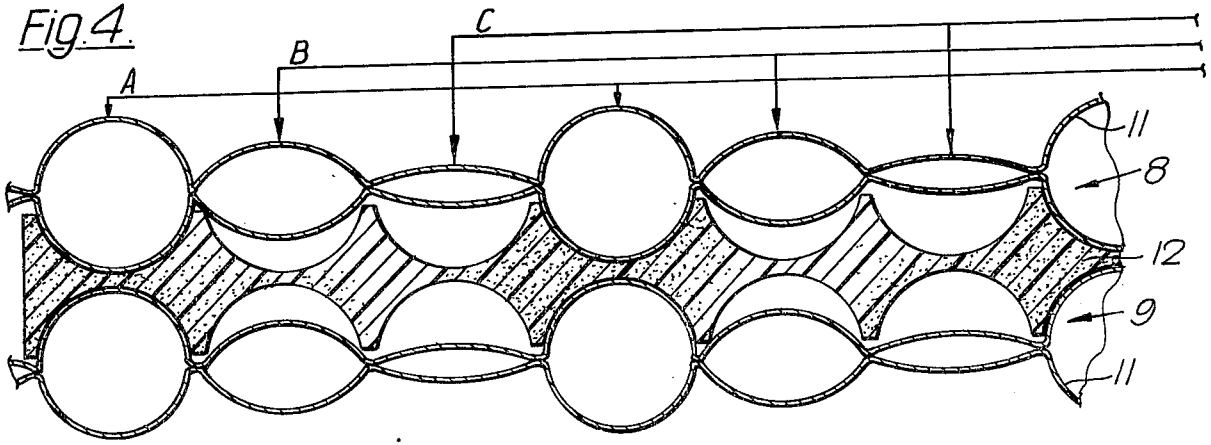
FIGS. 4 to 6 are schematic side-views showing stages in the cycle of operations.
Figure 5:
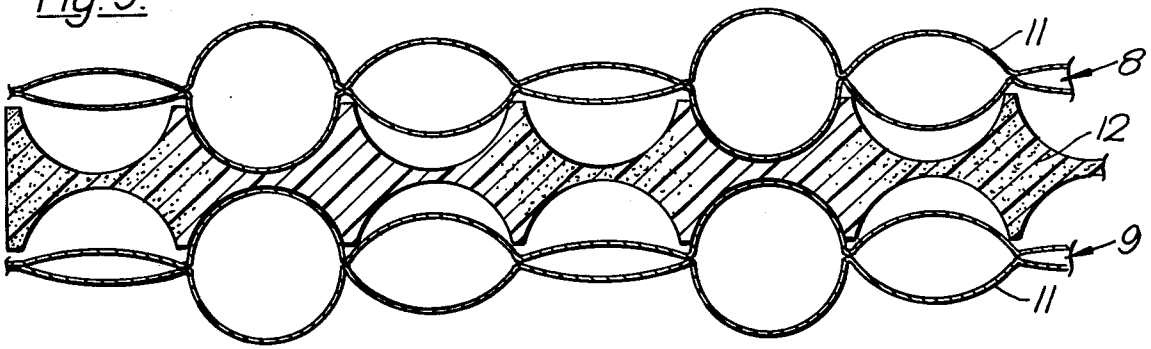
Figure 6:
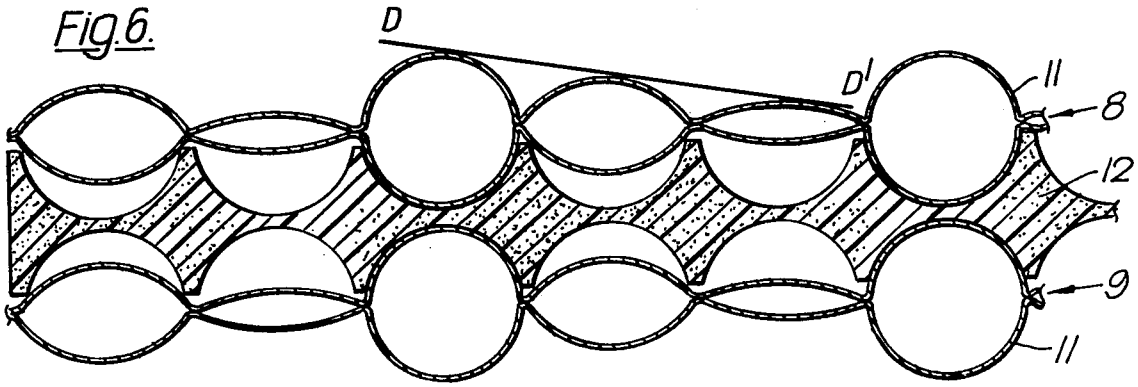

The cycle of operations of inflation and deflation of the two layers of tubes is shown in FIGS. 4 to 6.

FIG. 4 shows part of a mattress with the tubes of array A fully inflated, the tubes of array B partially inflated, and the tubes of array C fully deflated. In the first stage of the cycle, air is pumped into array C and into array B to inflate array C partially and array B fully; at the same time air is pumped out of array A. The result of this stage is shown in FIG. 5. In the next stage, air is pumped into array C and into array A to inflate array C fully and array A partially; at the same time air is pumped out of array B. The result of this is shown in FIG. 6. In the third and final stage of the cycle, air is pumped into array A and into array B to inflate array A fully and array B partially, while array C is deflated by suction and the mattress resumes the configuration shown in FIG. 4. The loss which takes place through the perforation 18 is primarily to air the patient and dry perspiration.

A patient lying horizontally on a mattress as shown in FIG. 4 is supported mainly by tubes of array A, and to a lesser extent by the tubes of array B, whereas the portions of his body over array C are substantially unsupported. Since the patient's weight is supported by $\frac{2}{3}$ of the mattress, the tubes need not be inflated very hard. If arrays A and B were simultaneously fully inflated and array C left deflated, the fully-inflated tubes on either side of the deflated tubes would tend to distort to fill the gaps, as in a mattress of only two arrays. The presence of the partially inflated tube (array B in FIG. 4) lessens the tendency to distort. Correspondingly by their presence, the pressure along a region of the patient's body is gradually lessened, instead of changing abruptly from zero to full supporting pressure.

It is preferred for the mattress to be used so that the head of the patient is at the right hand side of FIGS. 4 to 6. The tubes define inclined planes such as D, D' in FIG. 6 which can aid a patient to sit up by hindering him from slipping from right to left as seen in FIGS. 4 to 6. In addition the cycle of deflation-partial inflation-full inflation-deflation of each tube produces a "ripple" which flows from left to right as seen in FIGS. 4 to 6 and massages a patient whose head is at the right hand side of FIGS. 4 to 6 in the direction of venous flow.

A suitable operating pressure is 4 P.S.I., a relief valve 22 being provided to prevent this value from being exceeded.

Figure 8:
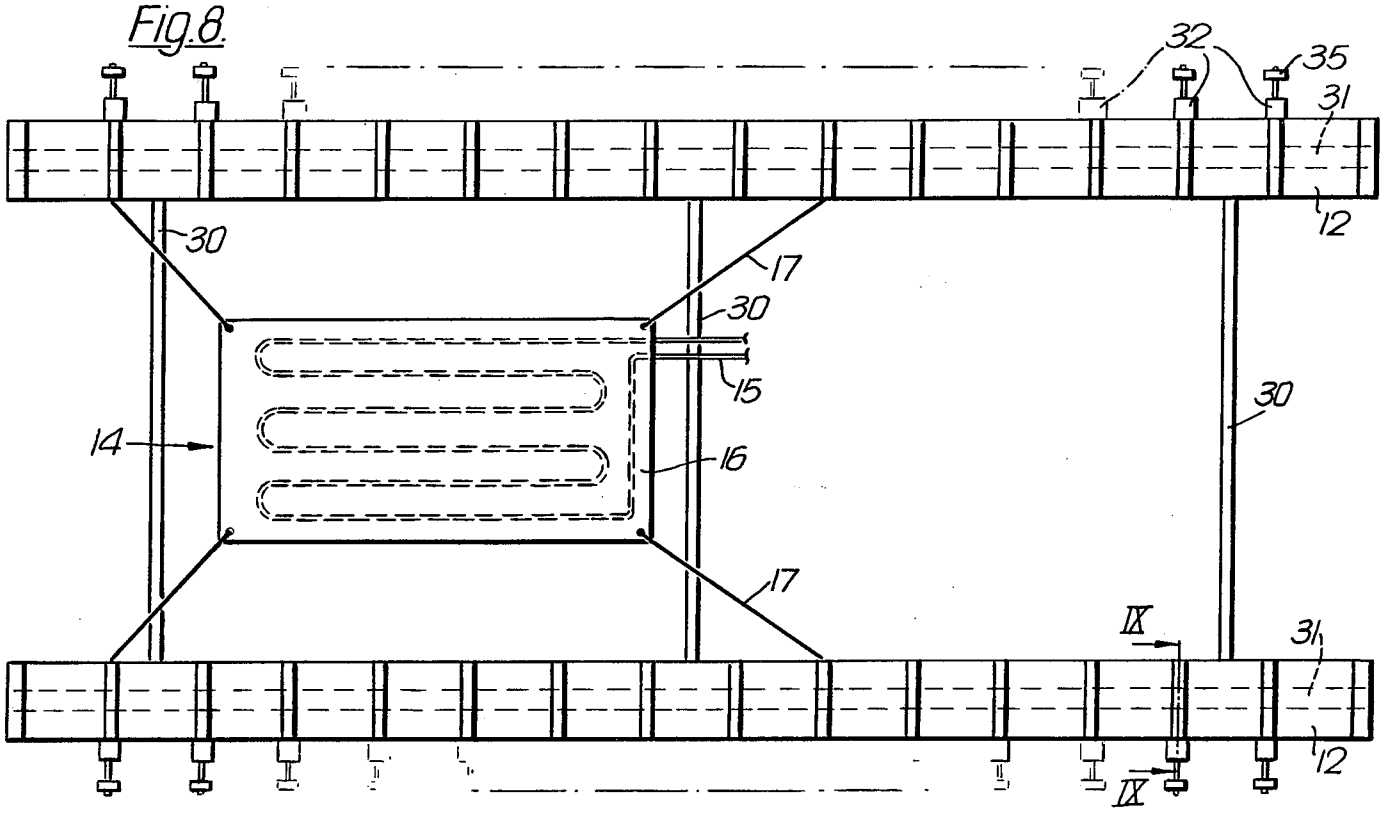
FIG. 8 is a plan view of a sensor in position in a mattress whose upper sheet has been removed.

It is preferred for the air pumped by the compressor to be divided into three parts. The first of these, suitably about $\frac{2}{3}$ of the total, is fed through a throttle valve 23 to the distributor 21 and thence to the mattress. A small proportion of the air is fed through a throttle 24 to a sensor 14. The sensor 14, as shown in FIG. 8, comprises a convoluted, open-ended, compressible sensor tube 15 sandwiched between two thin flexible sheets 16 only the upper of which is shown in FIG. 8. The sensor is placed either beneath the mattress or in between the two layers 8,9 when in use in an area where maximum load is expected. The sensor is held in place by ties 17. If the weight (e.g. of a patient) on the mattress is sufficient to overcome the resilience of the mattress, then the pressure exerted will close the sensor tube 15, and cut off the air flow through it. To improve the sensitivity of the sensor 14 additional tubes can be laid across the tubes 15 to form a grid so that an increase in pressure on these additional tubes can effect a closure of the tube 15 which might otherwise not take place. Closure of tubes 15 is detected by pilot valve 25 of known type which then automatically switches part of the air supply derived from a throttle 26 (which may be $\frac{1}{3}$ of the total) to the distributor system, thereby increasing the resilience of the mattress. When the pilot valve 25 is closed so that the $\frac{1}{3}$ is not used, it is relieved to atmosphere through the valve 22. Relief valve 18 allows escape of the air from throttle 24 when tube 15 is closed, and the pilot valve 25 is under pressure. A pneumatic visual indicator can be included in the compressed air line to show, independently of any electrical warning lights, whether or not air pressure is being maintained in the system. An appropriate indicator operating by air pressure is a low pressure type of "Rotowink" supplied by Norgren Fluidics which is a division of C. A. Norgren Ltd. of Shipton-on-Stour, Warks.

The inflatable flexible tubes 11 are conveniently made from plastics material. Each layer of tubes 11 may comprise two rectangular sheets of such material heat-sealed to form tubes which are sealed at both ends and connected to conduits adjacent one end. It is advantageous for the tubes of the upper layer 8 to have aprons 27 extending at the head, foot and sides by means of which the mattress may be secured on a bed. The head and foot aprons may be provided with loops close to the tubes, in which are located wooden battens 28 which run crosswise. The lower layer of tubes does not have aprons, but terminates head and foot with wooden battens 28. The corresponding upper and lower battens 28 are lashed to each other and to the formers 12 to strengthen the mattress structure. The formers 12 may also be connected by cords 30 at intervals.

The tubes 11 are suitably of 4" diameter, and the upper ones are penetrated by suitably 20 to 40 perforations.

The cycle of inflation/deflation may take 6 mins. A sheet of porous material, for example foam or wool, may be provided on top of the mattress.

A suitable material from which to make the formers 12 is "Ethafoam" of Dow Chemicals Inc. Each former 12 may be moulded in several sections which are either joined flexibly end to end, for example, by tying, to allow some play so that the mattress may be rolled up for storage when not in use or, alternatively, are stuck together to form a single piece. The latter method of joining is particularly preferred so that where a longitudinal horizontal joint is included in the former a strip of bright mild steel can be included along the joint to give the former some lateral rigidity. Such an arrangement is shown in FIGS. 8 and 9 which also illustrates the use of a strip 31 as an anchoring means for the lateral sides of each layer 8,9. Before sealing the two sections 12' and 12" of former 12 together encasing the strip 31 loops 32 of nylon webbing are passed around the strip at intervals along its length to protrude beyond the joint once sealed. The loops 32 are conveniently distributed along the former 12 so that, in use, they register with respective heat sealed joints of the plastics material forming the tubes 11. Tabs 33, each having a hole 34 are bonded to each end of the said heat sealed joints which can thus be readily and detachedly secured to the former 12 by means of e.g. toggles 35. The two layers 8,9 can thus be kept stretched widthways and prevented from forming longitudinal creases along their length which would adversely effect their working.

I claim:

1. A mattress comprising a plurality of inflatable tubes each of which extends across the mattress, said tubes being arranged in at least two layers wherein the tubes of each said layer are in side by side arrangement and said tubes of each said layer are divided into a plurality of arrays so that all the tubes of each respective array are inflatable in common and, means for aligning the tube of the respective layer of tubes such that the tube in use, are disposed in substantial vertical alignment with the tubes of in another layer.

2. A mattress as claimed in claim 1 wherein the said tubes are arranged in two layers.

3. A mattress as claimed in claim 1 wherein the said tubes of each said layer are divided into at least three said arrays.

4. A mattress as claimed in claim 1 wherein the said tubes of each said array are joined by conduits.

5. A mattress as claimed in claim 1 wherein the said plurality of arrays is adapted for connection to a pump assembly so that, in use, the said arrays are inflated and deflated sequentially.

6. A mattress as claimed in claim 5 in combination with a pump and distributing means whereby the said arrays are inflated and deflated sequentially.

7. A mattress as claimed in claim 1 wherein adjacent tubes in each said layer are mechanically joined along at least a part of their length.

8. A mattress as claimed in claim 1 wherein an upper surface of tubes forming an upper layer is perforated.

9. A mattress as claimed in claim 1 wherein each of said tubes extends across a width of the mattress.

10. A mattress as claimed in claim 9 further comprising at least one former which extends a length of the said mattress.

11. A mattress as claimed in claim 10 comprising a former of resilient material disposed between adjacent layers of inflatable tubes at each lateral edge of the mattress.

12. A mattress as claimed in 11 further comprising means to secure each said layer detachably to its respective formers at lateral edges of the said mattress.

13. A mattress as claimed in claim 1 further comprising sensor means adapted to sense bottoming out through the mattress and, in use, to increase inflation pressure in the said tubes.

14. A mattress as claimed in claim 13 wherein the said sensor means comprises an open ended tube disposed in a labyrinthine pattern below the mattress and means passing a continuous stream of gas through the tube, the sensor means further including valve means responsive to blockage of said stream of gas to augment the pressure of gas in the said mattress pipe.

* * * * *

UNITED STATES PATENT AND TRADEMARK OFFICE

CERTIFICATE OF CORRECTION

PATENT NO. : 4,193,149

DATED : March 18, 1980

INVENTOR(S) : Robert J. D. Welch

It is certified that error appears in the above-identified patent and that said Letters Patent are hereby corrected as shown below:

Column 6, line 49, "5/8" should read --1/3--

Column 6, line 52, "5/8" should read --1/3--

Column 8, line 3, "tube" should read --tubes--

Column 8, line 3, "layer" should read --layers--

Column 8, line 4, "tube" should read --tubes--

Column 8, line 5, delete "of"

Signed and Sealed this

*Twenty-eighth* Day of *October 1980*

[SEAL]

*Attest:*

SIDNEY A. DIAMOND

*Attesting Officer*

*Commissioner of Patents and Trademarks*